US005114153A

United States Patent [19]

Rosenwinkel et al.

[11] Patent Number: 5,114,153

[45] Date of Patent: May 19, 1992

[54] MECHANICAL CARD DISPENSER AND METHOD OF PLAYING A CARD GAME

[75] Inventors: Donald A. Rosenwinkel, Oak Park, Ill.; Randall H. Moormann, Georgetown, Mass.

[73] Assignee: Breslow, Morrison, Terzian & Associates, Inc., Chicago, Ill.

[21] Appl. No.: 652,945

[22] Filed: Feb. 8, 1991

[51] Int. Cl.[5] ..... A63F 1/14

[52] U.S. Cl. ..... 273/292; 273/149 R

[58] Field of Search ..... 273/149 R, 149 P, 292

[56] References Cited

U.S. PATENT DOCUMENTS

| | | | |
|---|---|---|---|
| 2,099,187 | 11/1937 | Atti | 273/149 R |
| 3,131,935 | 5/1964 | Gronneberg | 273/149 R |
| 4,033,590 | 7/1977 | Pic | 273/149 R |
| 4,515,367 | 5/1985 | Howard | 273/149 R |

FOREIGN PATENT DOCUMENTS

| | | | |
|---|---|---|---|
| 2152018 | 7/1985 | United Kingdom | 273/149 R |

*Primary Examiner*—Benjamin Layno

*Attorney, Agent, or Firm*—Dick and Harris

[57] ABSTRACT

The present invention is concerned with providing a game that mechanically dispenses additional cards to a player in a dramatic manner. Card play initially determines whether a player may have to operate the dispenser. However, a chance element in operation of the device may still permit the player to escape receiving any additional cards. Depression of a button in accordance with card play, indexes a disc having variously spaced apart detents for actuating a battery motor driven eccentric wheel that expels the cards from a reservoir.

20 Claims, 3 Drawing Sheets 14
32
40
46
54
56
60
64
68
72
74
80
84
86
88
90
94
96
98
100
102
106
108
110
112
114
118
120
124
126
128
130
132
134
142
144
26
61
6
7
8
9

MECHANICAL CARD DISPENSER AND METHOD OF PLAYING A CARD GAME

BACKGROUND OF THE INVENTION

1. Field of the Invention

This invention relates generally to games and more particularly to games in which players attempt to discard all of their cards.

2. Background Art

There are numerous prior art games in which players attempt to be the first one to dispose of all of their cards, or at least try not be the last player still holding cards. A classic example of the latter type of card game is "OLD MAID." Although more recent, the "UNO" card game, which is exemplary of the first mentioned type of game in which players strive to be the first to dispose of all the cards from their hand, is a popular game. Part of the entertainment, and hence popularity, of the "UNO" card game, and other similar prior art games, is based on that aspect of play by which the players acquire additional cards in their hand. Thus, again for example in the "UNO" card game, a player not being able to match the upwardly facing card in the discard pile by number or by color, and not having a wild card, must draw cards from the central stack until being able to make the required match or play a wild card. The entertainment and interest of such a card game would be greatly enhanced by a mechanical device which distributes additional cards to a player in a dramatic manner. Yet additional interest and entertainment could result from a chance element in operating the device.

SUMMARY OF THE INVENTION

The present invention is concerned with providing a game that mechanically dispenses cards to a player in a dramatic manner. Card play initially determines whether a player may have to operate the device. However, a chance element in operation of the device may still permit the player to escape receiving any additional cards.

BRIEF DESCRIPTION OF THE DRAWINGS

For a better understanding of the present invention, reference may be had to the accompanying drawings in which:

FIG. 9 is an enlarged scale, fragmentary sectional view taken generally along line 9—9 of FIG. 5.

DETAILED DESCRIPTION

Figure 1:
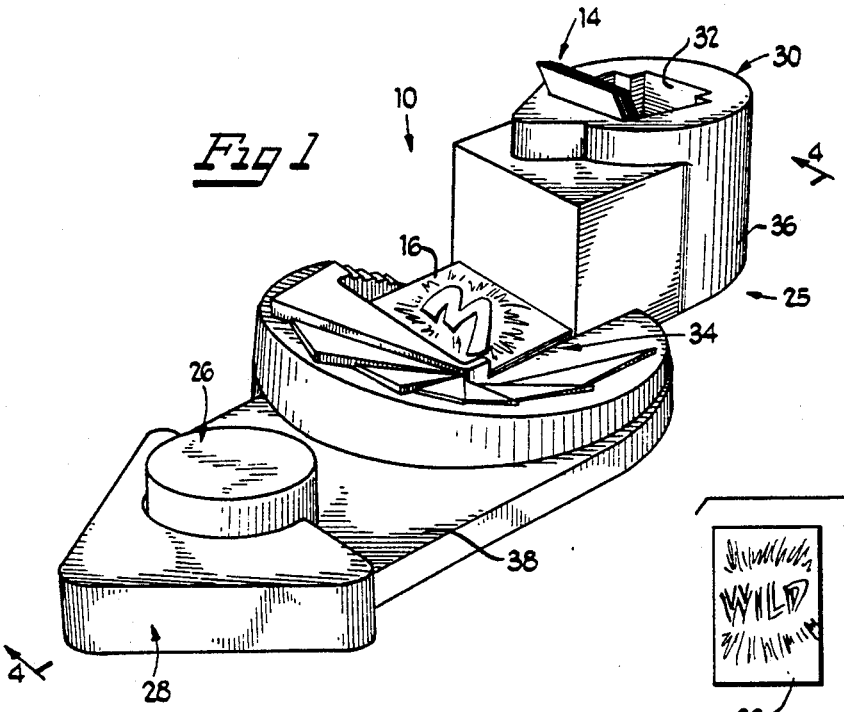
FIG. 1 is a perspective view of a game embodying the present invention.
Figure 2:
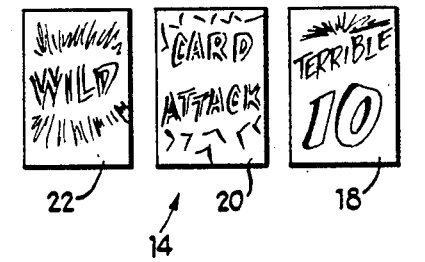
FIG. 2 is a top plan view of the face of exemplary ones of cards included in the game.

Referring now to the drawings in which like parts are designated by like reference numerals throughout the several views, there is shown in FIG. 1 a game 10 including a supply of cards 14. Game 10 preferably includes a deck of cards 14 that contains a total of eighty-four cards, not all of which are shown in the drawings. There are sixty-four cards numbered "2" through "9", two in each of four different colors, of which face-up card 16 is exemplary. Also included in the supply of cards are eight "TERRIBLE 10" cards 18 two in each of the four colors, four "CARD ATTACK" cards 20, one in each of the four colors and eight "WILD" cards 22.

In addition to cards 14, game 10 also includes a card holder and dispenser 25 that has an attack actuator button 26 at a pointed end 28. Card holder and dispenser 25 also includes a card dispensing end 30 having a card receiving and dispensing reservoir 32 capable of receiving at least some of the supply of cards 14. There is a discard holding area 34 intermediate pointed end 28 and card dispensing end 30 in an upper housing part 36. A lower housing part 38 with a generally planar base 40 that is supportable upon a generally planar playing surface, such as a table, mates with upper housing part 36.

Figure 4:
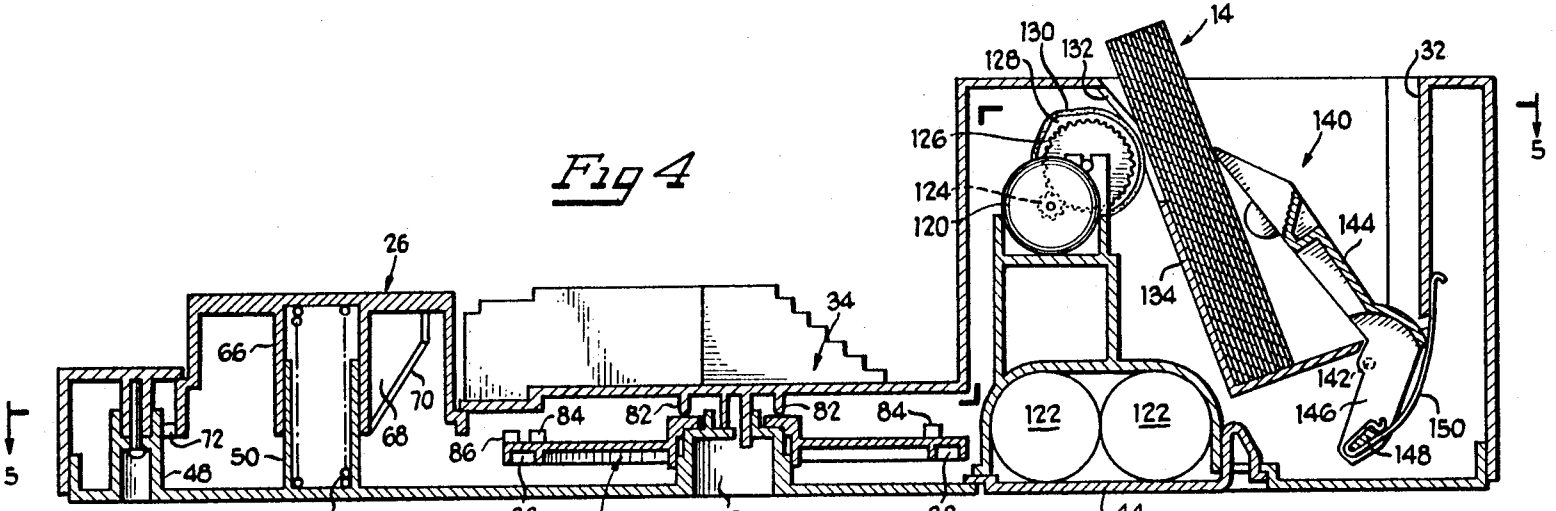
FIG. 4 is an enlarged scale, sectional view taken generally along line 4—4 of FIG. 1.

Extending upwardly from base 40 is a battery container 42 to which access is provided through an opening in the bottom of base 40. A removable panel 44, which is best shown in FIG. 4, closes container 42. Atop container 42 is a motor support 46. Adjacent the tip of pointed end 28 there is a mounting boss 48 for securing lower housing 38 to upper housing 36. Inboard of the tip, but still generally within pointed end 28, is a tubular support 50 for attack actuator button 26. Lower housing 38 also includes a generally centrally disposed, stepped support boss 52. In addition, there are two generally vertical support piers 54 and 56, together with an arcuate anvil 58, projecting upwardly from base 40 of lower housing 38. Also projecting upwardly from base 40 are spaced apart sets of slide guides 60 and 62 plus a pair of spaced apart hooks 64 disposed between the two sets of slide guides.

On the underside of attack actuator button 26 is a generally centrally disposed sleeve 66 which fits over tubular support 50, as is best shown in FIG. 4. Also formed on the underside of attack actuator button 26 and extending generally radially outwardly from sleeve 66 is a fin 68 having a cam surface 70. Attack actuator button 26 also includes a generally radially extending tab 72 having an arcuate notch 74 that cooperates with mounting boss 48 to limit rotational movement of actuator attack button 26. A coil spring 76 is received in tubular support 50 and is compressed between base 40 and the underside of button 26 to bias the button upwardly.

Figure 3:
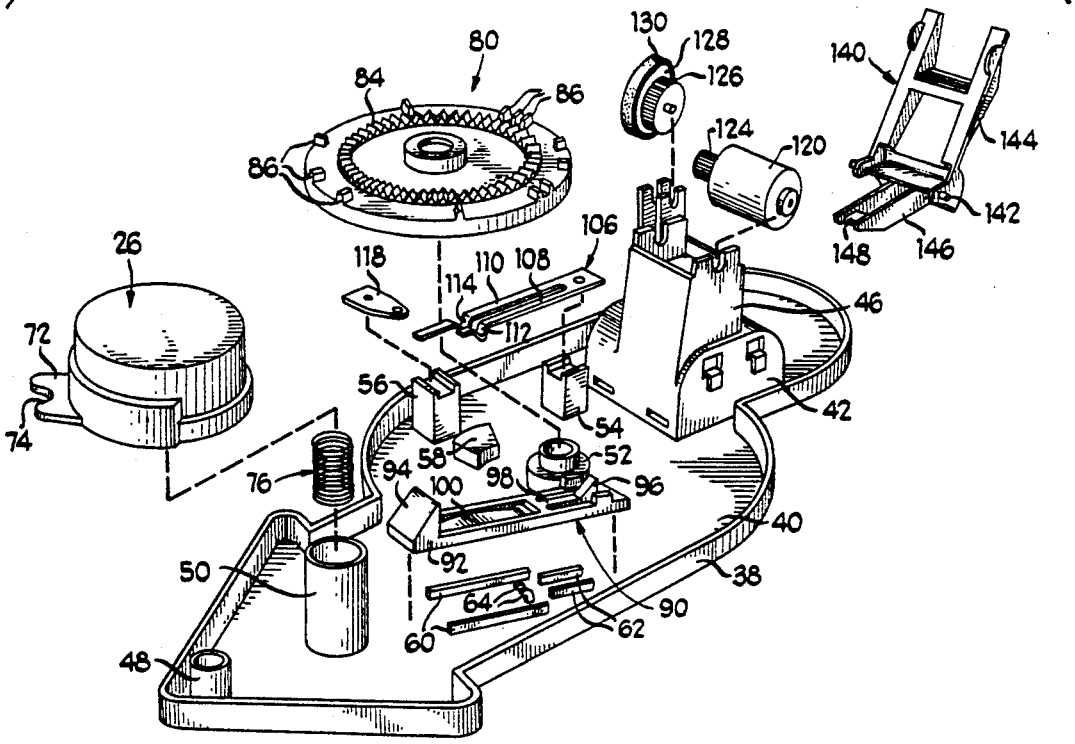
FIG. 3 is an exploded perspective view of part of the game.
Figure 5:
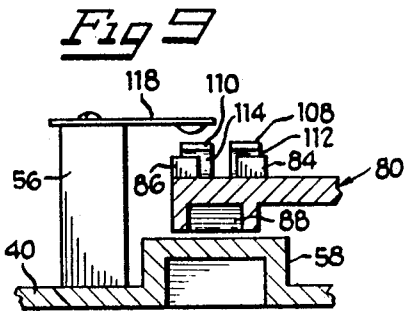
FIG. 5 is a sectional view taken generally along line 5—5 of FIG. 4.
Figures 5, 8, 10:
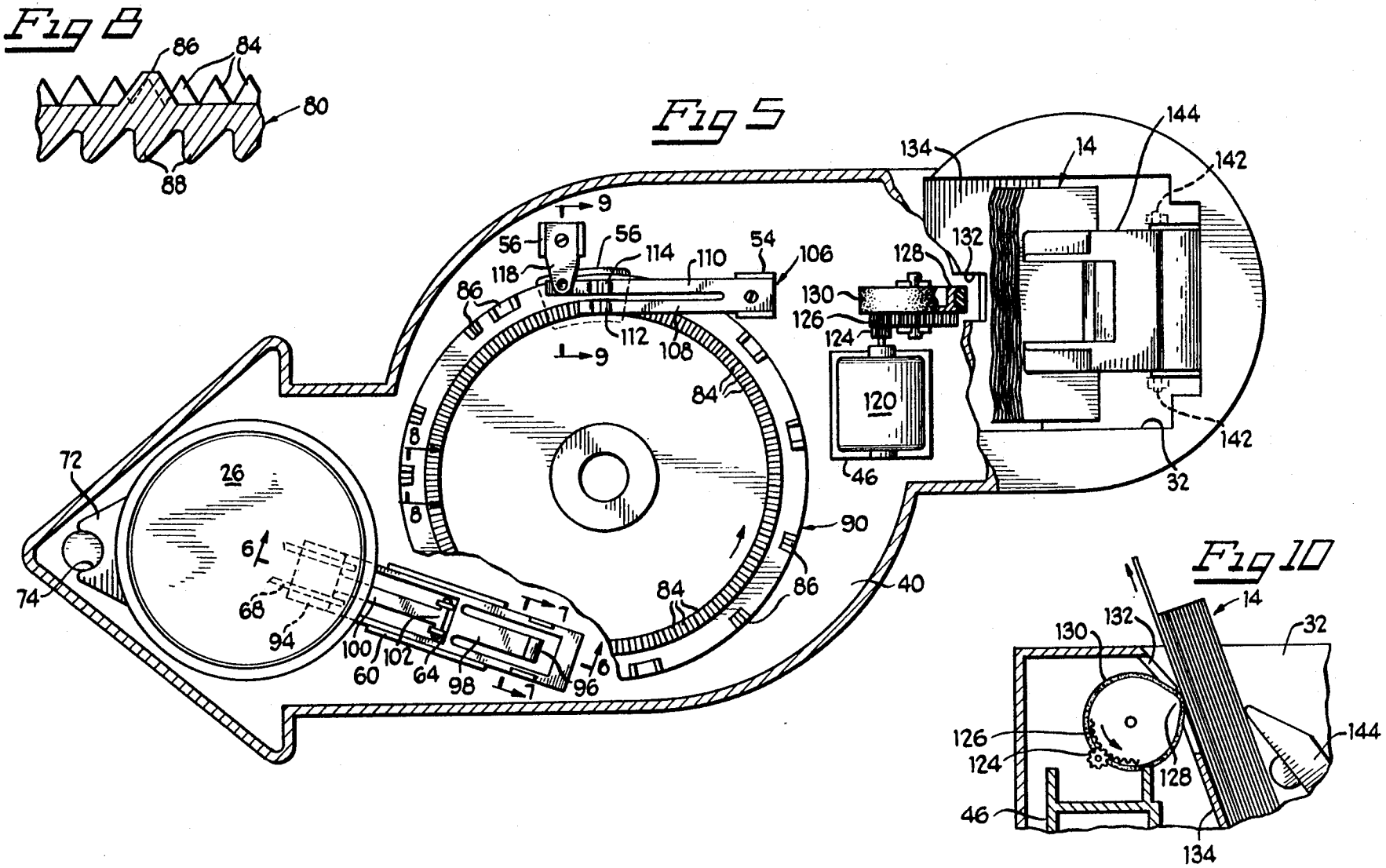
FIG. 8 is an enlarged scale, sectional view taken generally along line 8—8 of FIG. 5.
FIG. 10 is a fragmentary sectional view similar to part of FIG. 4 but showing the card dispenser in operation.

Supported for rotation on stepped boss 52, about a generally vertical axis, or more accurately, an axis substantially transverse to the plane of base 40, is a rotatable piece or disc 80. As is best shown in FIG. 4, a number of downward projections 82 on the underside of upper housing 36 restrain movement of disc 80 with respect to stepped support boss 52 in an axial direction. The upwardly facing side of disc 80 has an inner ring of teeth 84. Radially outwardly from ring 84, generally adjacent the peripheral edge of disc 80, are a series of upwardly projecting detents 86 that are spaced around disc 80 at irregular intervals. Thus, as will be best appreciated from FIGS. 3 and 5, there are some detents 86 that are widely spaced from the next adjacent detent and others that are relatively closely positioned in groups of two or three. Each of detents 86 has a flat top rather than being pointed as are teeth 84. On the underside of disc 80, as is shown in FIG. 8, are a series of ratchet teeth 88. As with the inner ring of teeth 84, ratchet teeth are evenly spaced apart at regular intervals. There are far fewer detents 86 than either of teeth 84 or teeth 88.

Mounted for sliding reciprocating movement along the upper surface of base 40 is a slide member 90 which is conveniently made from a resilient material such as CELCON M90 plastic. Reciprocable slide member 90 includes a forward end 92 having an angled cam surface 94. Adjacent the opposite end of slide member 90 is a pawl 96 carried by a flexible arm 98. Pawl 96 and arm 98 are an integral part of slide member 90. Between forward end 92 and flexible arm 98 is an elongated flexible biasing leaf 100 which has a transverse bar 102 at its free end. Again, biasing leaf 100 and its transverse bar 102 are integrally formed as part of the slide member. As will be readily appreciated from FIGS. 3 and 5, reciprocable slide member 90 is positioned between guides 60 with guides 62 fitting on either side of flexible arm 98 and with bar 102 fitting into spaced apart hooks 64. Thus, elongated reciprocable slide member 90 is captured against movement in a direction transverse to its length and is biased toward attack actuator button 26 and out of engagement with disc 80.

Figure 7:
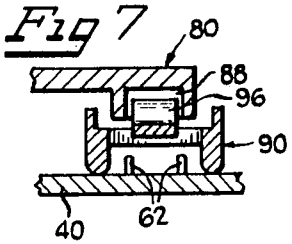
FIG. 7 is an enlarged scale, fragmentary sectional view taken generally along line 7—7 of FIG. 5.
Figure 6:
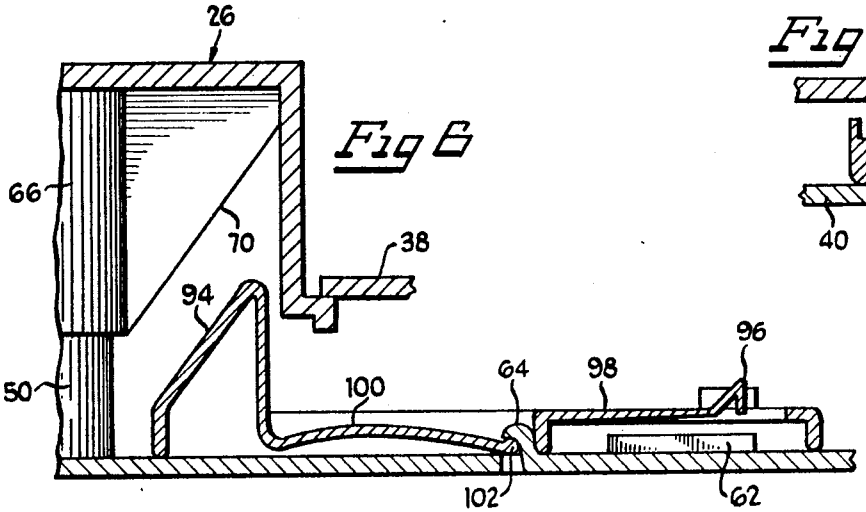
FIG. 6 is a fragmentary sectional view taken generally along line 6—6 of FIG. 5.

However, as will be appreciated, particularly from FIG. 6, as attack actuator button 26 is depressed, angled cam surface 70 on the underside of the button will engage angled cam surface 94 on reciprocable slide member 90 and push it away from the button end of the housing against the bias of leaf 100. Pawl 96 is disposed under disc 80 such that movement of pawl 96 in a direction away from the button, upon depression of the button, will cause pawl 96 to serially engage one of ratchet teeth 88 on the underside of disc 80 and rotationally index disc 80 in a counterclockwise direction as viewed in FIGS. 3 and 5. Accordingly, each depression of actuator button 26 indexs rotatable disc or piece 80 an incremental step by serial engagement of each of the ratchet 88. The engagement of pawl 96 and one of ratchet teeth 88 is best shown in FIG. 7. When pressure is released from attack actuator button 26, it will be biased back up by spring 76 and flexible leaf 100 will bias reciprocable slide member 90 and pawl 96 back out of engagement with the ratchet tooth 88.

Secured at one of its ends to pier 54 is an elongated metal spring switch contact member 106 having bifurcated arms 108 and 110. Each of the bifurcated arms includes a downwardly directed respective V-bend 112 and 114. As is best illustrated in FIGS. 5 and 9, spring switch contact member 106 is disposed over disc 80 with V-bend 112 of arm 108 extending downward toward disc 80 between adjacent ones of the inner ring of teeth 84. V-bend 114 of arm 110 depends down toward disc 80 between adjacent ones of detents 86. Both V-bends 112 and 114 are so disposed as to engage, respectively, one of the inner ring of teeth 84 or one of detents 86. Atop pier 56 another metal switch contact member 118 is secured normally spaced apart from outer arm 110 forming a normally open switch.

Engagement of V-bend 112 with inner ring of teeth 84 releasably restrains the indexed rotation of disc 80 as it is advanced by engagement of pawl 96 with a ratchet tooth 88 so that disc 80 does not advance more than the desired indexed amount each time button 26 is depressed. Of course, as disc 80 rotates in the counterclockwise direction, as illustrated in FIG. 5, engagement of the teeth of ring 84 with V-bend 112 will push inner arm 108 upwardly each time a tooth engages the V-bend. Similarly, each time one of the spaced apart detents 86 engages V-bend 114, outer arm 110 will be pushed upwardly into contact with switch member 118 making electrical contact. As is best illustrated in FIG. 9, anvil 58 is closely spaced to the underside of disc 80 in the area where V-bends 112 and 114 engage the inner ring of teeth 84 and detents 86, respectively, in order to limit any undesired downward deflection of the periphery of disc 80 as a result of such engagement.

Mounted atop motor support 46 is a motor 120 which is powered by batteries 122 in battery container 42. Suitable wiring (not shown) connects motor 120, batteries 122, switch contact member 106 and switch contact member 118 such that when outer arm 110 is deflected upwardly by one of detents 86 to make electrical contact with switch member 118, motor 120 is turned on for as long as engagement between detent 86 and V-bend 114 maintains arm 110 and member 118 in electrical contact. Thus, reciprocable slide member 90 and disc 80 connect attack actuator button 26 with motor actuating switch members 106 and 118. Since each of detents 86 is formed with a flat top, unlike the pointed tops of teeth 84, when V-bend 114 is pushed up by detent 86, it will rest on the top of the detent until disc 80 is again rotationally indexed. Motor 120 has an output drive gear 124. Journaled for rotation on motor support 46 is a coaxial gear 126 and a single lobe cam or eccentric 128 around the periphery of which is a boot 130 made of a resilient, high coefficient of fiction material such as KRATON-7705 or the like. Gear 126 is in driving engagement with motor output gear 124.

Card receiving and dispensing reservoir 32 is formed with a slot or opening 132 in a forward angling wall 134. Opening 132 is aligned with eccentric 128 such that as eccentric 128 rotates the lobe, or more particularly boot 130, will from time to time extend beyond wall 134 through opening 132. As is best illustrated in FIGS. 4 and 10, wall 134 of reservoir 32 is angled forwardly toward tip end 28 such that cards 14 placed in reservoir 32 bear against wall 134 and hence are in position to be contacted by that part of eccentric 128 extending through opening 132.

To assist in maintaining cards 14 in contact with wall 134 and/or to feed the cards into eccentric 128 a pressure lever 140 is provided. Pressure lever 140 is generally L-shaped and is mounted for pivotal movement about a pair of trunnions 142 having an axis that generally extends along the junction of a long leg 144 and a short leg 146. Long leg 144 extends into reservoir 32 and engages card 14 adjacent the top of the long leg. Adjacent the free end of lower short leg 146 is a bar 148 about which one end of a metal return spring 150 is secured. The other end of return spring 150 abuts against the inside of upper housing part 36 as is best shown in FIG. 4. Thus, pressure lever 140, or more particularly long leg 144, is biased into pressure transmitting engagement with whatever number of cards 14 are positioned in reservoir 32 between wall 134 and long arm 144. Lever 140 may be manually pivoted back against return spring 150 to insert additional cards 14. When motor 120 is energized by depression of attack button 26 indexing disc 80 to bring a detent 86 into contact with V-bend 114 to raise arm 110 into electrical engagement with switch contact member 118, eccentric 128 will rotate in the counterclockwise direction illustrated in FIG. 10 and expel the bottommost card it comes into contact with through opening 132 out of reservoir 32 by throwing the card upwardly and outwardly toward tip end 28.

It will be appreciated that not every time attack button 26 is depressed results in actuation of motor 126 because of the chance element resulting from the spacing of detents 86. While, because of the spacing of detents 86 it will sometimes be necessary to depress button 26 a large number of times before motor 20 is actuated and cards are thrown at the person actuating the button, other times, just a few depressions of button 26 will actuate motor 120. Moreover, when detents 86 are very closely spaced together, the next depression of button 26 after motor 120 is actuated may not even shut off the motor.

To begin play by two to four players, ten cards are dealt face down to each player. If there are five or more players, each player is dealt seven cards. The top card of the remaining cards is placed face up in discard area 34 and the rest of the cards are placed in receiving and dispensing slot 32 with the face sides of the cards disposed toward attack actuator button 26. In the event that the top card turned face-up in the discard area is a "TERRIBLE 10," "CARD ATTACK" or "WILD" card, it is buried in the deck and another card is turned up until a "2" through "9" number card is obtained. Players proceed in turn to discard cards from their hands, each player attempting to be the first one to get rid of all of the cards and win the round of play. During play of "TERRIBLE 10" and "CARD ATTACK" cards, play may pass from one player to another with intervening players losing a turn.

The face-up, topmost card of the discard pile determines the next card that may be played. When a "2" through "9" number card is face-up, any single card having either the same number or the same color may be discarded. A player may also discard more than one card of the same number if they match the number of the face-up discard, regardless of the color of the cards being played. Alternatively, any pair of cards of the same number and color that match the color of the top discard, regardless of the number of the top discard, may be played. In addition, two or more cards, in numerical sequence, that are of the same color as the face-up discard or starting with the same number as the face-up discard may be played. The sequence does not have to start from the number on the face-up discard and the player discarding the sequence may determine its order, that is whether it goes from low to high or from high to low. Multiples of a single number may not be played within a sequence.

"WILD" cards 22 may be played as a single card and become whatever color and number the player announces. In addition, "WILD" cards may be used in the middle or at either end of a sequence and may also be played as part of multiples of the same number card. When used as a part of multiples of the same number and played last, the "WILD" card serves to change the color of the top discard to whatever the player announces. A "WILD" card cannot be used as a "TERRIBLE 10" or "CARD ATTACK" card.

"TERRIBLE 10" cards 18 are played on the same color as the face-up discard or on any other "TERRIBLE 10." In addition, "TERRIBLE 10" may be used after a number "9" card in a low to high sequence. However, a "TERRIBLE 10" card may not be used to start a high to low sequence. When a "TERRIBLE 10" card is played, card holder and dispenser 25 is rotated to point attack actuator button 26 at the player to the left of the one who has just played the "TERRIBLE 10" card. If the player to the left has a "TERRIBLE 10" card of any color, it may be played as a defense and the machine is then rotated to point attack actuator button 26 at the next player to the left. However, if the player does not have a "TERRIBLE 10" card to play in defense, the player must operate dispenser 25 by depressing the attack actuator button once. In the event that the one depression of attack actuator button 26 energizes motor 120 and cards are dispensed, the player must then quickly depress the attack actuator button as many times as necessary to shut-off the machine and is then stuck with all of the expelled cards. If the motor is not energized, the card holder and dispenser is then pointed at the next player to the left who must either defend with a "TERRIBLE 10" card or depress attack actuator button 26. Card holder and dispenser 25 is rotated to the left until a player depresses the attack actuator button and cards are expelled. After the dispenser is turned off and the unfortunate player collects the expelled cards, play then passes to the next player on the left who resumes discard play treating the face-up "TERRIBLE 10" card as a normal number card.

"CARD ATTACK" cards 20 are played on the same color as the face-up discard or on another "CARD ATTACK" card. When a "CARD ATTACK" card is played, it is the only card played and there is no defense. The player discarding the "CARD ATTACK" card selects the opponent at whom dispenser 25 is pointed and who must operate the dispenser and depress the attack actuator button until cards are expelled. There is no way to completely avoid collecting cards as a result of play of a "CARD ATTACK" card. All that the attacked player can do is try to stop the attack as quickly as possible to limit the number of dispensed cards that the player must collect. Once the attack initiated by the play of the "CARD ATTACK" card is over, play passes to the next player on the left. The player to whom play passes may then play the same color card as the "CARD ATTACK" card, a "WILD" card or a another "CARD ATTACK" card.

A player must play at least one card on each turn. When a player does not have a card that may be discarded in accordance with the rules, a card that does not comply with the rules is played and the player must then depress the attack actuator button the same number of times as the number appearing on the card. If the last card in a player's hand is a "CARD ATTACK" card of the same color as the face-up discard, the player may use it to attack another player. However, if the "CARD ATTACK" card is not of the same color, the attack is then directed against the player playing the "CARD ATTACK" card. Once all of the cards are expelled from reservoir 32, the cards in discard area 34, except for the face-up discard, are used to refill the reservoir. The game may be extended to any number of rounds agreed upon among the players with the player having the lowest score at the completion of the last agreed upon round being the overall winner.

While a particular embodiment of the present invention has been shown and described, variations and modifications, such as use of a spring wound motor, will occur to those skilled in the art. It is intended in the appended claims to cover all such variations and modifications as fall within the true spirit and scope of the present invention.

What is claimed as new and desired to be secured by Letters Patent is:

1. A game comprising in combination:
a supply of cards;
a housing having a bottom;
an reservoir in the housing for receiving at least some of the supply of cards;
a motor mounted within the housing;
means driven by the motor for dispensing a bottommost card from the cards in the reservoir;
means for actuating the motor;
a manually depressible actuator carried by the housing; and
means connecting the actuator and the actuating means such that the motor is actuated in response to some but not all manual depressions of the actuator.

2. The game of claim 1 in which the motor is an electrical motor powered by batteries.

3. The game of claim 2 in which:
the actuating means includes a normally open switch; and
the connecting means includes one or more detents selectively engageable with the open switch.

4. The game of claim 3 in which the connecting means includes a rotatable piece and the one or more detents are spaced around the rotatable piece.

5. The game of claim 4 in which the detents are irregularly spaced apart.

6. The game of claim 5 including means rotatably indexing the rotatable piece by incremental steps in response to each depression of the actuator.

7. The game of claim 6 including means releasably restraining the indexing of the rotatable piece.

8. The game of claim 6 in which:
the indexing means includes a member carried by the housing for reciprocating movement;
the member includes means biasing the member out of indexing engagement with the rotatable piece; and
the member includes a cam surface engageable with the manually depressible actuator.

9. The game of claim 8 in which:
the member includes a pawl; and
the rotating piece includes a series of teeth each of which is serially engageable by the pawl.

10. The game of claim 9 in which there are less detents than teeth.

11. The game of claim 1 in which:
the reservoir includes an inclined wall adjacent the dispensing means;
an opening in the wall;
the cards in the reservoir are supported by the wall in dispensing communication with the dispensing means through the opening; and
means biasing the cards in the reservoir against the wall.

12. The game of claim 11 in which the biasing means includes:
a pivotally mounted lever; and
a biasing element urging the lever into pressure exerting engagement with the cards in the reservoir.

13. The game of claim 12 in which the dispensing means includes a rotating eccentric that periodically extends through the opening.

14. The game of claim 1 in which the connecting means includes one or more detents selectively engageable with the actuating means.

15. The game of claim 14 in which the connecting means includes a rotatable piece and the one or more detents are irregularly spaced around the rotatable piece.

16. The game of claim 15 including:
means for rotatably indexing the rotatable piece by incremental steps in response to each depression of the actuator;
the indexing means including a member carried by the housing for reciprocating movement;
the member including means biasing the member out of indexing engagement with the rotatable piece; and
the member including a cam surface engageable with the manually depressible actuator.

17. The game of claim 16 in which:
the member includes a pawl;
the rotating piece includes a series of teeth, each of which is serially engageable by the pawl; and
there are less detents than teeth.

18. A method of playing a game comprising the steps of:
supplying a number of players with a supply of cards;
providing a card holder and dispenser that upon operation will expel cards;
dealing a predetermined number of cards to each player;
placing one of the remaining cards face up in a discard pile;
putting the remainder of the cards in the dispenser;
allowing the players to proceed, in turn, to discard a card upon the discard pile;
permitting a player upon discarding a particular card to direct the card holder and dispenser toward an opponent; and
causing the opponent to operate the card holder and dispenser.

19. The method of playing a game of claim 18 including the step of requiring the opponent to continue to operate the card holder and dispenser until it expels cards.

20. The method of playing a game of claim 18 including step of letting the opponent direct the card holder and dispenser toward another opponent if the operation of the card holder and dispenser did not result in the expelling of cards.

* * * * *